United States Patent [19]

Carter

[11] 4,024,834

[45] May 24, 1977

[54] TEMPERATURE COMPENSATED DOCTOR BLADE

[75] Inventor: Robert Albert Carter, Rochester, N.Y.

[73] Assignee: Xerox Corporation, Stamford, Conn.

[22] Filed: Aug. 11, 1975

[21] Appl. No.: 603,489

[30] Foreign Application Priority Data

Sept. 24, 1974 United Kingdom ..... 41414/74

[52] U.S. Cl. ..... 118/7; 118/261; 118/DIG. 23

[51] Int. Cl.[2] ..... B05C 1/00; B05C 11/04

[58] Field of Search ..... 101/350, 365; 118/123, 118/7, 126, 119, 261, DIG. 23

[56] References Cited

UNITED STATES PATENTS

| | | | |
|---|---|---|---|
| 3,029,779 | 4/1962 | Hornbostel | 118/119 X |
| 3,029,780 | 4/1962 | Justus et al. | 118/126 |
| 3,529,315 | 9/1970 | Dunlap et al. | 15/256.51 |
| 3,667,428 | 6/1972 | Smith | 118/261 X |
| 3,888,173 | 6/1975 | Ritzerfeld | 118/7 X |
| 3,918,400 | 11/1975 | Cheeseman | 118/261 |

*Primary Examiner*—John P. McIntosh
*Attorney, Agent, or Firm*—J. J. Ralabate

[57] ABSTRACT

A temperature compensated doctor blade system is disclosed for controlling the amount of liquid on a substrate. Variation in temperature is found to cause wide variation in liquid viscosity which affects doctor blade pressure requirements. An expandable chamber containing a temperature responsive fluid is used to control the pressure applied to a flexible doctor blade.

6 Claims, 3 Drawing Figures

TEMPERATURE COMPENSATED DOCTOR BLADE

BACKGROUND OF THE INVENTION

This invention relates to doctor blade systems and more particularly to doctoring in imaging systems utilizing liquid developers.

The formation and development of images on the surface of photoconductor material by electrostatic means is well known. The basic xerographic process as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light and developing the resulting electrostatic charge pattern image by depositing on the image a finely divided electroscopic marking material referred to in the art as "toner". The toner will normally be attracted to those areas of the layer which retain a charge thereby forming a toner image corresponding to the electrostatic charge pattern. The powder image may then be transferred to a support surface such as paper and permanently affixed to the support by any suitable means such as heat fixing or solvent fixing. Alternatively, the powder image may be fixed to the photoconductive layer if elimination of the powder transfer step is desired. In addition, instead of forming a charge pattern by uniformly charging a photoconductor followed by image-wise light exposure, a charge pattern may be formed by directly charging an insulating or a photoconductive layer in image configuration. Other methods are known for applying electroscopic particles to the imaging surface. Included within this group are the "cascade" development technique disclosed by E. N. Wise in U.S. Pat. No. 2, 618,552; the powder cloud development technique disclosed by C. F. Carlson in U.S. Pat. No. 2,221,776; and the magnetic brush process disclosed for example in U.S. Pat. No. 2,874,063.

Development of a charge pattern image may also be achieved with liquid rather than dry developer materials. In conventional liquid development more commonly referred to as electrophoretic development an insulating liquid vehicle having finely divided solid material dispersed therein contacts the imaging surface in both charged and uncharged areas. Under the influence of the electric field associated with charged image pattern, the suspended particles migrate towards the charged portions of the imaging surface separating out of the insulating liquid. This electrophoretic migration of charged particles results in the deposition of the charged particles on the imaging surface in image configuration. Electrophoretic development of a charge pattern may, for example, be obtained by pouring the developer over the image surface, by emersing the image surface in a pool of the developer or by presenting the liquid developer on a roller and moving the roller against the imaging surface. The liquid development technique has been shown to provide developed images of excellent quality and to provide particular advantages over other development methods in offering ease in handling.

Automatic copying machines employing liquid development techniques generally can be divided into two categories. In the first, an electrophotographic sheet is developed and the sheet and developed image is used as final copy. In the second, an image is developed on a photoconductive surface and the image is subsequently transferred to a transfer sheet which forms the final copy with the photoconductive element being reused for subsequent copies.

A preferred method for developing electrostatic charge patterns is shown in British patent specification No. 880,597. In this system an applicator roll is utilized to present liquid developer to the surface of the member carrying the charge pattern. The amount of liquid on the applicator roll is carefully controlled by using a doctoring or metering blade. It has been found with this system that the quality of the final images produced depend greatly on temperature of the liquid developer in the system. It has been determined that variation in temperature causes a viscosity change in the liquid developer which affects the final developed image density. In general, at higher operating temperatures the reproduced images are more dense than at lower operating temperatures. This result can be explained when it is realized that at higher operating temperatures the liquid becomes less viscous and thus more readily transferable at the image developing station. Accordingly, to provide uniform results at an operating temperature of 10° C and at 40° C where the viscosity change can be as much as 90% requires a system for temperature compensation.

SUMMARY OF THE INVENTION

It is therefore an object of this invention to provide an improved imaging system. It is another object of this invention to provide an imaging system capable of forming quality images over a relatively wide range of operating temperatures.

Another object of this invention is to provide a temperature compensated doctor blade system for developing images.

The above objects and others are accomplished in accordance with this invention by providing an imaging system in which a charge pattern image is developed by contacting the surface bearing the charge pattern with liquid carried by an applicator roll. The doctor blade is operatively connected to means responsive to temperature which means cause the flexible doctor blade to be pressed more or less firmly against the applicator roller. The temperature compensating means in accordance with this invention is a temperature expandable fluid acting on a piston or diaphragm which is connected directly or indirectly to a doctor blade.

The temperature compensated doctor blade of this invention is particularly suitable for the liquid development of charge patterns formed on the surface of a photoconductive member such as described in British patent specification No. 880,957. British patent specification No. 880,957 discloses apparatus and method for the liquid development of charge patterns wherein liquid developer is presented to a photoreceptor having an electrostatic charge pattern on its surface, said presentation being by means of an applicator comprising lands and valleys such that the liquid developer is contained in the valleys out of contact with the photoreceptor. In such an arrangement, the liquid developer is attracted from the valleys to the charged areas in image configuration. A typical example of such an arrangement is an electrostatic copying apparatus wherein the applicator is a rigid cylindrical member or roll having on its surface a pattern of ridges and grooves which comprise the lands and valleys, respectively. The roll is positioned to come into contact with a photoreceptor bearing on its surface a charge pattern image, the photoreceptor suitably being a cylindrical member comprising a conductive support and a photoconductive coating which supports the charge pattern and typically the image thus formed is then transferred to an image receiving member such as paper by pressure contact.

Using the development techniques described above liquid developer is suitably applied to an applicator roll in excess of requirements and the surface to the roll is engaged by a blade prior to arrival at the photoreceptor to meter or doctor the amount of liquid on the roll surface so as at least substantially to remove all liquid from the lands and to reduce the level of the liquid in the valleys to below the level of the lands.

Typically, the grooves of the applicator roll are about 60 microns deep with their centres across the lands about 100 microns apart. For such application the blade is suitably made of a flexible plastic or elastomeric material such as polyurethane or neoprene and has a rectangular front edge maintained in pressure engagement with the roll surface during operation at a trailing angle with respect to the direction of movement of the applicator roll therepast. It has been found that for uniform doctoring or metering of the liquid developer on the applicator roll, the blade material should have a durometer Shore Hardness of between 60 and 90 and the blade angle should be maintained within close limits. For example, a 3.15 mm thick doctor blade of durometer Shore Hardness 75 ± 5, acting on a 25 mm diameter applicator roller is maintained at an angle to the tangent to the roll surface at the line of engagement of the blade with the tangent of 48° ± 1° and is loaded at a pressure variable between about 6 gm. per mm length and 18 gm. per mm length. To provide temperature compensation of these pressures, the doctor blade mounting is connected to a piston or diaphragm which is acted on by a temperature expandible fluid.

BRIEF DESCRIPTION OF THE DRAWINGS

The invention will be more clearly understood upon consideration of the invention particularly with reference to the following description of the drawings, wherein:

Referring now to FIG. 1 there is shown a liquid development system in which the doctor blade temperature compensating means of the present invention may be utilized.

Figure 1:
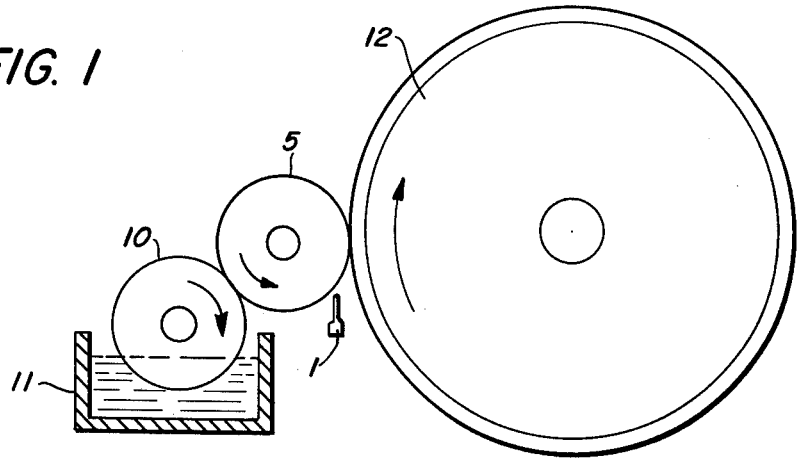
FIG. 1 is a schematic illustration of one form of liquid development system utilizing the temperature compensated doctor blade of this invention.

Liquid developer in reservoir 11 is supplied to the applicator roll 5 by a supply roller 10 running in reservoir 11, a small gap, e.g. 0.25 mm being provided between the two rolls such that an excess of developer is applied to the applicator roll in order to give a thorough covering of developer along its complete periphery. Applicator roller 5 is during operation in pressure engagement with the surface of photoreceptor drum 12. Doctor blade 1 is arranged to engage the applicator roll 5 to doctor or meter the liquid developer applied thereto by supply roll 10, prior to engagement with the surface of photoreceptor drum 12. The temperature compensating device, not shown, acts on doctor blade 1.

Figure 2:
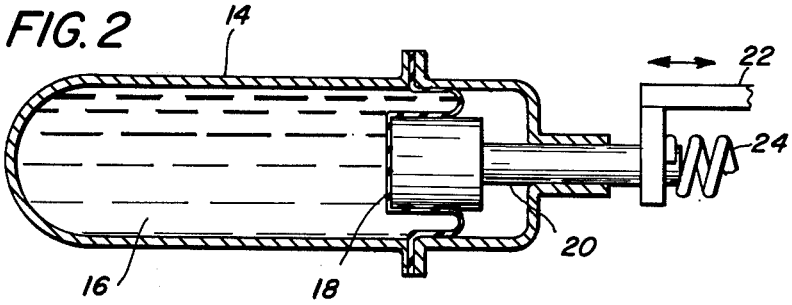
FIG. 2 is a side cross-section of one embodiment of the doctor blade.

Referring now to FIG. 2, there is shown container 14 which is fixedly mounted to the frame, not shown, of the machine. Container 14 contains expandable fluid 16. By way of example, container 14 may be of steel and fluid 16 may be methyl alcohol. It is preferred that the walls of container 16 be fairly rigid. The fluid may be a liquid such as mercury or a vapour or gas. As the temperature of the container 14 and fluid 16 increases in response to increase in machine or ambient temperatures, fluid 16 expands forcing piston 20 outwards. The seal 18 between the fluid and piston is shown here as a constant area rolling diaphragm. The movement of piston 20 caused by the expansion and contraction of fluid 16 is transmitted by suitable linkages and member 22 to the doctor blade loading springs not shown. Spring 24 is utilized to eliminate hysteresis in the system and to keep the piston 20 firmly in contact with diaphragm 18. Where desired, container 14 may be immersed in the reservoir 11 of liquid developer to overcome differences in heat capacity of the liquid developer system and the temperature compensating device. The apparatus shown in FIG. 2 provides a response directly proportional to the fluid volume.

Figure 3:
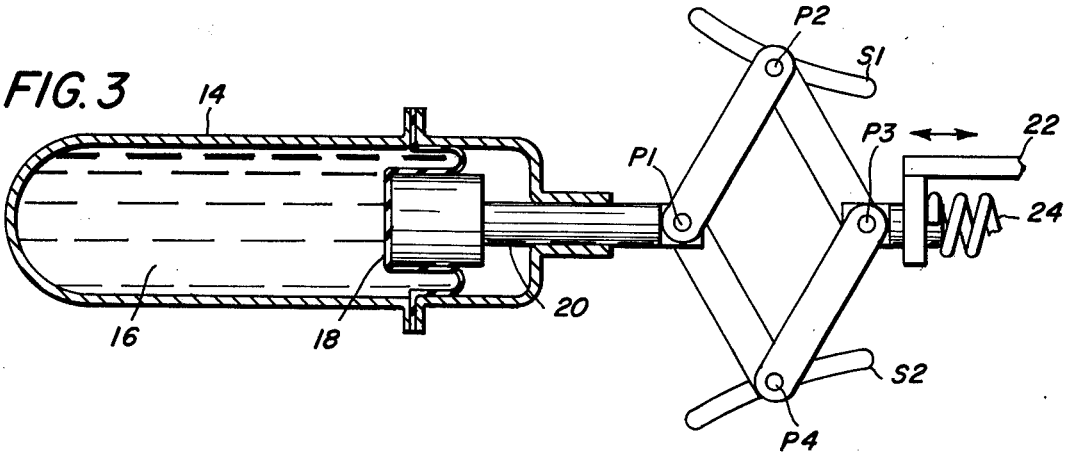
FIG. 3 is a cross-section of a second embodiment of the present invention to provide a non-linear relationship between the temperature compensating means and the doctor blade.

Referring now to FIG. 3, there is shown an apparatus suitable for providing a non-linear relationship between fluid volume and doctor blade pressure. Parts similar to those of FIG. 2 are given similar numbers. Here four linkages are freely pivoted at pivot points P1, P2, P3 and P4. Pivots P2 and P4 are constrained to move in slots S1 and S2 in a backplate, not shown, so that as pivot point P1 is moved by piston 20, pivot point P3 moves in a manner dictated by the slots. The movement caused by the temperature compensation device at increased operating temperatures is again transmitted to the doctor blade loading springs and the consequent change in doctor blade pressure causes the doctor blade to penetrate further into the valleys of the applicator roll removing more of the liquid developer preventing "over-development" of the image. Similarly, at lower temperatures les pressure is applied allowing more liquid developer to be available to develop the charge pattern which is required for good quality dense images.

While particular embodiments have been described above, it will be appreciated that various modifications may be made to the specific details referred to herein without departing from the scope of the invention as defined in the appended claims. Furthermore, although a particular application for the apparatus of this invention has been described above, it should be appreciated that the apparatus finds general use in other applications. For example, the apparatus may find use for urging a cleaning blade into contact with a surface to remove liquid therefrom.

Anyone skilled in the art will have other modifications occur to him based on the teachings of the present invention. These modifications are intended to be encompassed within the scope of the this invention.

What is claimed is:

1. Apparatus in which a blade is urged against a surface for controlling the amount of liquid on said surface, comprising temperature compensating means adapted to increase pressure at increased operating temperatures and decrease pressure at decreased operating temperatures which comprise a fixed sealed expandable chamber containing a temperature responsive fluid and linking means responsive to said increased pressure and said decreased pressure of said expandable chamber for urging said blade into contact with said surface.

2. The apparatus of claim 1 wherein said expandable chamber is in a container and said means responsive to the expansion and contraction of said chamber includes a piston moveably mounted in said container.

3. The apparatus of claim 1 wherein said means responsive to the expansion and contraction of said chamber includes means to provide a non-linear relationship between fluid volume change and doctor blade pressure.

4. The apparatus of claim 1 wherein said blade is relatively flexible and said surface is relatively inflexible.

5. The apparatus of claim 1 wherein said surface is defined by the periphery of a roll.

6. The apparatus of claim 5, wherein said roll has a peripheral surface comprising a pattern of lands and valleys.

* * * * *